US007958660B2

(12) United States Patent
Fitzpatrick et al.

(10) Patent No.: US 7,958,660 B2
(45) Date of Patent: Jun. 14, 2011

(54) AMMUNITION MAGAZINE

(75) Inventors: Richard M. Fitzpatrick, Denver, CO (US); Michael T. Mayberry, Denver, CO (US); Eric C. Burt, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 219 days.

(21) Appl. No.: 12/103,617

(22) Filed: Apr. 15, 2008

(65) Prior Publication Data

US 2011/0005113 A1 Jan. 13, 2011

Related U.S. Application Data

(60) Provisional application No. 60/941,646, filed on Jun. 1, 2007.

(51) Int. Cl.
*F41A 9/65* (2006.01)

(52) U.S. Cl. ..... 42/50

(58) Field of Classification Search ..... 42/49.01, 42/49.02, 50; D22/108
See application file for complete search history.

(56) References Cited

U.S. PATENT DOCUMENTS

| | | | | | |
|---|---|---|---|---|---|
| 3,087,270 | A * | 4/1963 | Stoner | 42/50 |
| 3,736,686 | A * | 6/1973 | Moller et al. | 42/6 |
| D244,285 | S * | 5/1977 | Sofinowski | D22/108 |
| 4,139,959 | A * | 2/1979 | Howard et al. | 42/50 |
| 4,514,922 | A * | 5/1985 | Farrar et al. | 42/50 |
| 4,580,364 | A * | 4/1986 | Vyprachticky | 42/50 |
| 4,688,344 | A * | 8/1987 | Kim | 42/50 |
| 4,831,761 | A * | 5/1989 | Kulakow | 42/50 |
| 4,888,900 | A * | 12/1989 | Howard | 42/50 |
| 4,905,394 | A * | 3/1990 | Predazzer | 42/17 |
| 5,113,605 | A * | 5/1992 | Kim | 42/50 |
| 5,291,679 | A * | 3/1994 | Wollack et al. | 42/50 |
| 5,309,660 | A * | 5/1994 | Blackamore | 42/50 |
| 5,495,687 | A * | 3/1996 | Waiser | 42/50 |
| 5,638,626 | A * | 6/1997 | Westrom | 42/50 |
| 5,956,878 | A * | 9/1999 | Yang | 42/50 |
| 6,560,907 | B1 * | 5/2003 | Vieweg | 42/50 |
| 7,533,483 | B1 * | 5/2009 | Alzamora et al. | 42/50 |
| 7,621,063 | B2 * | 11/2009 | Fitzpatrick et al. | 42/50 |
| 2004/0020092 | A1 * | 2/2004 | Christensen | 42/49.01 |

* cited by examiner

*Primary Examiner* — Bret Hayes
(74) *Attorney, Agent, or Firm* — Geoffrey E. Dobbin

(57) ABSTRACT

The present invention is an ammunition magazine, preferably made of a glass fiber reinforced polymer, utilizing a structurally enhancing ridge, angular guide rails and a follower made to interface with said guide rails to reduce wobble. The preferred embodiment also features a protective cover that distributes forces from the spring to more structurally sound areas of the magazine, thus reducing feed end splay, and may include an ammunition indication system comprised of at least one window and a noticeable marker on the follower spring. The follower and magazine casing are also designed to interface to prevent the follower from popping out of the feed end and the floor plate of the magazine utilizes a locking plate and sliding relationship between the floor plate, locking plate and magazine to secure the floor plate onto the magazine casing.

4 Claims, 5 Drawing Sheets

AMMUNITION MAGAZINE

CROSS-REFERENCES TO RELATED APPLICATIONS

This Application claims priority on earlier filed U.S. Provisional Application No. 60/941,646, filed on Jun. 1, 2007, and incorporates the same in its entirety by reference.

FIELD OF THE INVENTION

The present invention relates to the field of firearms and more particularly relates to an improved ammunition magazine.

BACKGROUND OF THE INVENTION

Ammunition magazines are well known in the art of firearms. Their basic construction is a containment shell with two open ends. One end is deemed the "floor" of the magazine and is covered by a plate while the opposite end is the "feed" end and interfaces with the weapon. Inside the volume defined by the shell and plate is a spring and follower assembly. When ammunition is loaded into the magazine, the ammunition pushes the follower down towards the floor and thereby compresses the spring. In use, when one magazine is expended, the compressed spring releases and pushes the follower and associated ammunition upwards toward the feed end and the next round of ammunition is thereby readied.

Prior magazines have been manufactured in many different configurations and of different materials. Perhaps the best known in the U.S. are the AK-47 and the USGI AR15/M16 magazines. These magazines function similarly, though they are made with slight variations to interface with their host system. Of notable difference is that the AK-47 magazine has a relatively constant curvature while the AR15/M16 magazine has a less curved lower region that gradually resolves to a more linear function towards the feed end. Both use the same type of internal system. Of particular note with both, and all follower magazine systems, is that the system works well only as the follower smoothly travels the inside of the magazine. This is to say that the follower evenly distributes pressure on the round stack, even as other factors of the magazine and stack, including magazine curvature, case taper and upward pitch of the follower, are all considered and addressed. As the follower must move, there is room for the follower in all the known prior art magazines to move axially, or "wobble" and possibly jam. This is notorious in the AR15/M16 magazine style as the geometry of the magazine is inherently not uniform. The parent application involves a solution to these issues for a larger capacity magazine (30 rounds) by presenting a magazine with a constant internal curve and a follower with severely limited motion. However, these solutions are not well received with a smaller (20 round) capacity magazine, as curved 20 round magazines tend not to fit certain weapons. Consumers also tend to prefer their smaller capacity magazines straight and straight magazines are easier to mold.

The present invention is a polymer magazine with an angularly shaped guide rails to interface with the internal follower, thereby restricting, but not totally inhibiting axial motion of the follower. The magazine also features a two-piece floor plate locking system. The present invention represents a departure from the prior art in that the magazine of the present invention allows for more controlled and level motion of the follower while the magazine is loaded or unloaded.

SUMMARY OF THE INVENTION

In view of the foregoing disadvantages inherent in the known types of ammunition magazines, this invention provides an improved, smaller capacity magazine. As such, the present invention's general purpose is to provide a new and improved magazine that is backwards compatible with known weapon platforms and presents a more stable follower and follower path.

To accomplish these objectives, the improved ammunition magazine comprises a plurality of later angularly shaped guide rails within the magazine shell and a follower that is configured to abut them. By interfacing with more internal structure, most non-advantageous linear and axial motion is inhibited and the follower is then more controlled in its progress. The follower is constructed to allow advantageous fore/aft axial tilt, of approximately 10 degrees (1 degree of case taper per 10 cases on one side of a staggered stack). The magazine also features a polymer construction and can accommodate an ammunition load indicator system. The magazine also features a cover for storage.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the ammunition magazine is herein described. It should be noted that the articles "a", "an" and "the", as used in this specification, include plural referents unless the content clearly dictates otherwise.

Figure 2:
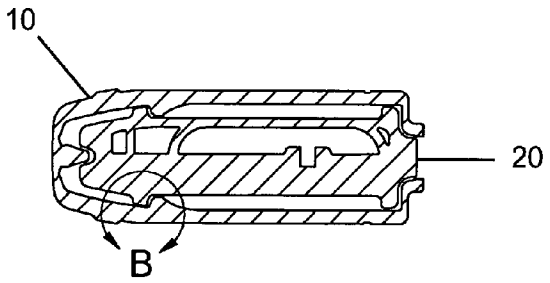
FIG. 2 is a sectional view of the magazine of FIG. 1, taken along line A-A.
Figure 3:
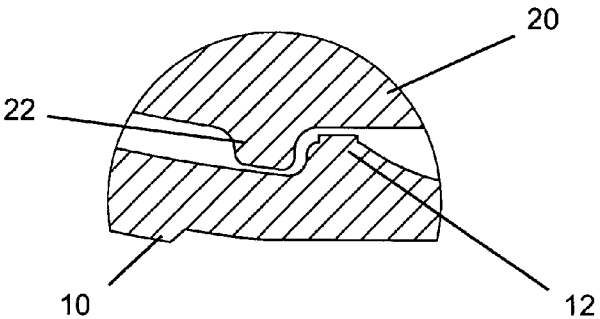
FIG. 3 is a close-up view of the magazine of FIG. 2, taken in circle B.
Figure 1:
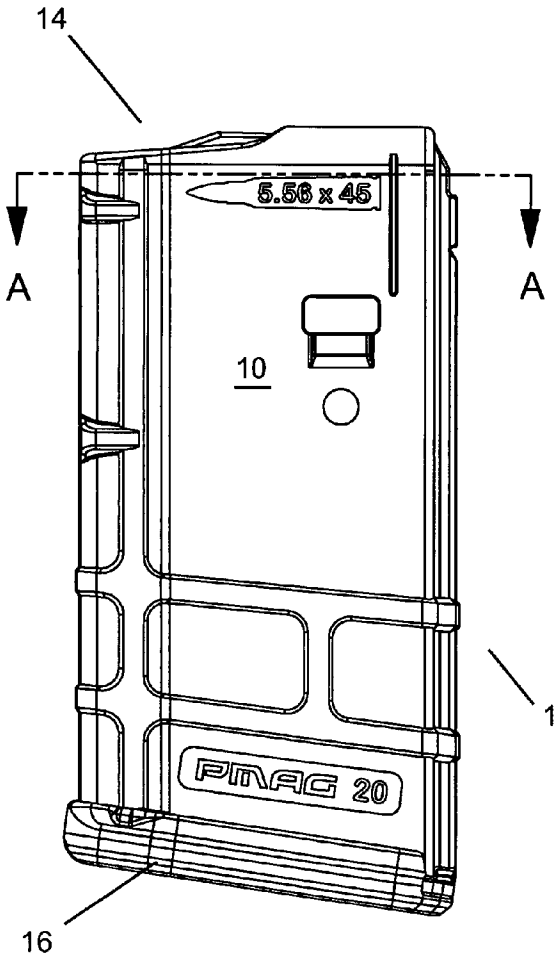
FIG. 1 is a left plan view of the magazine according to the present invention.
Figure 4:
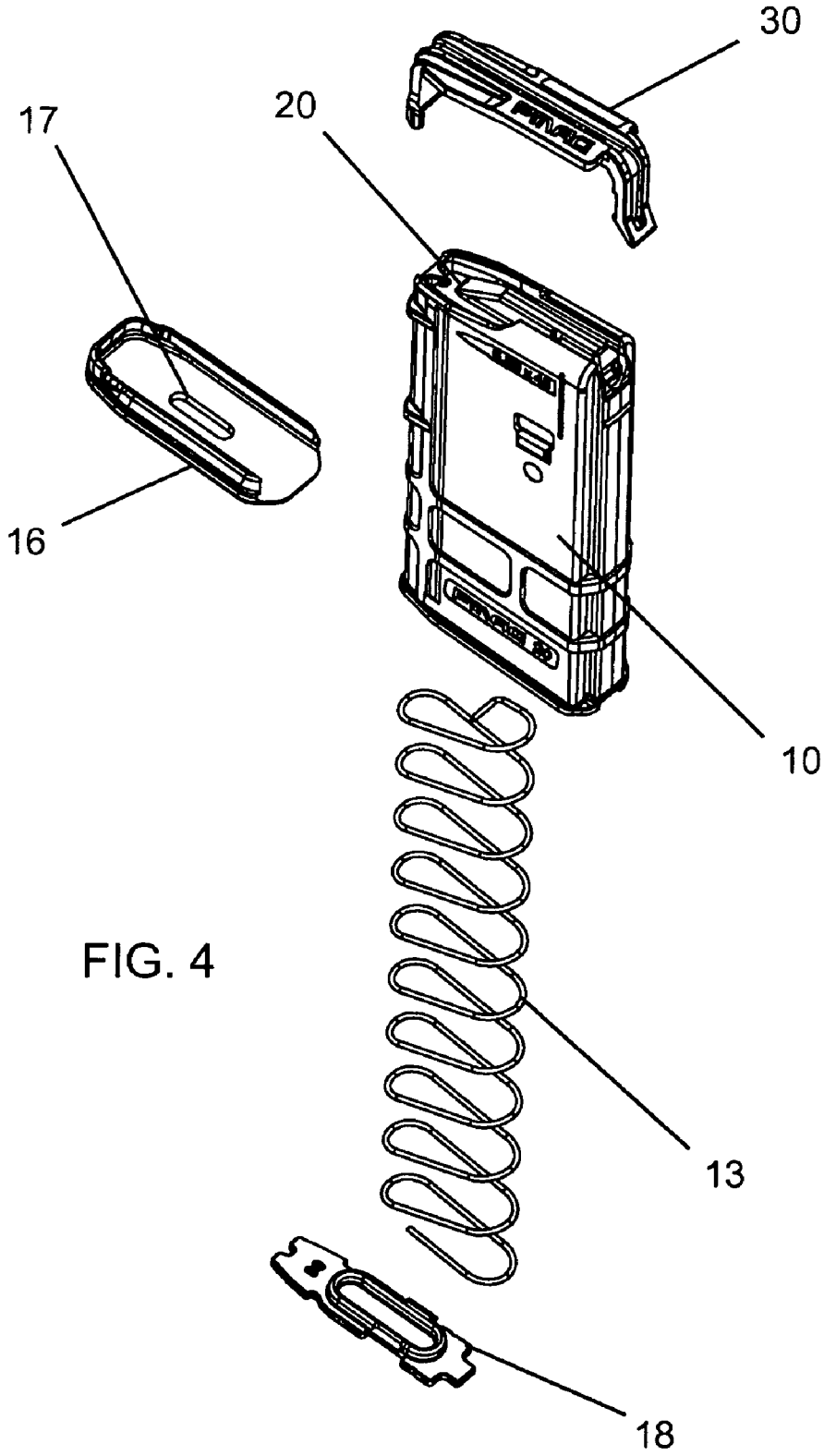
FIG. 4 is an exploded view of the magazine according to the present invention, with an impact cover.
Figure 5:
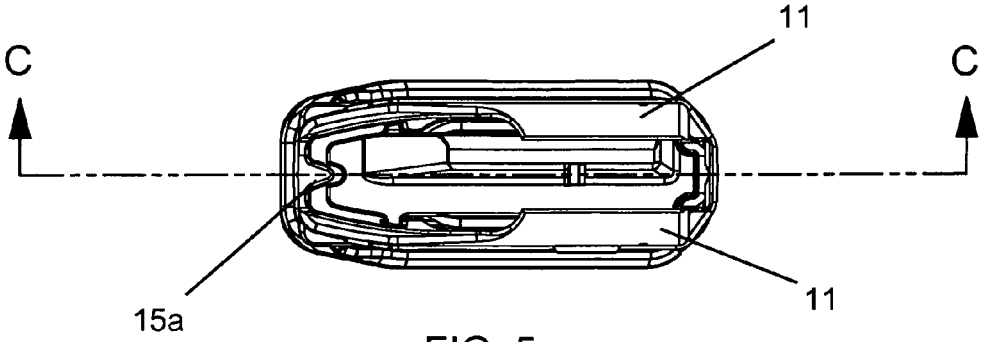
FIG. 5 is a top plan view of the magazine of FIG. 1.
Figure 6:
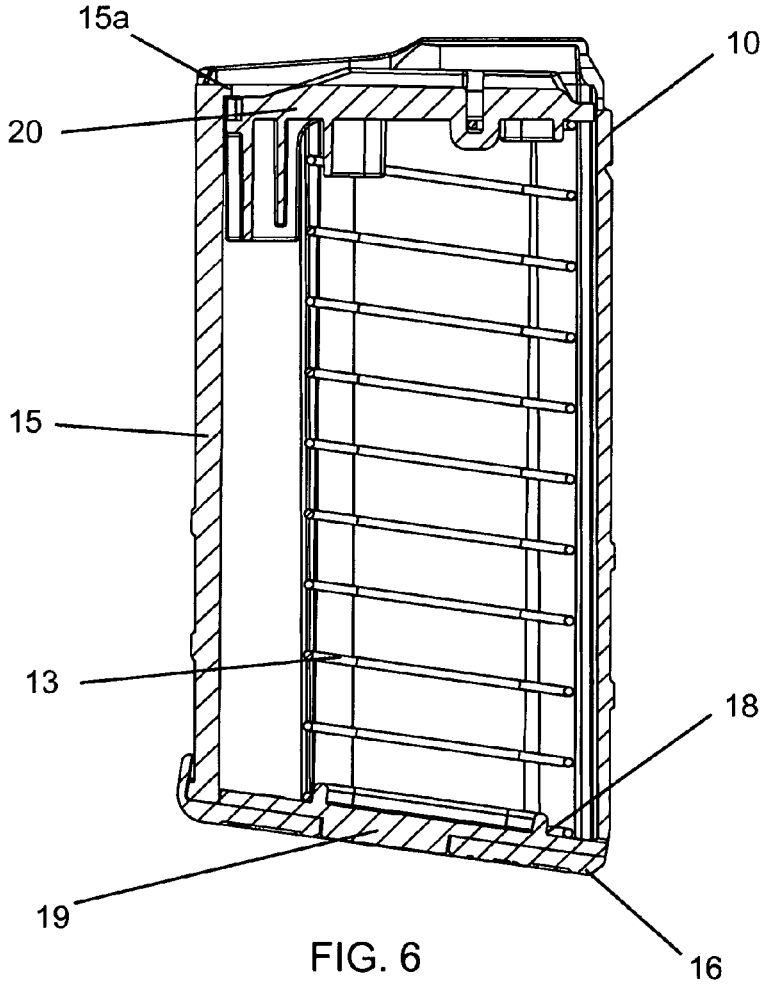
FIG. 6 is a sectional view of the magazine in FIG. 5, taken along line C-C.
Figure 7:
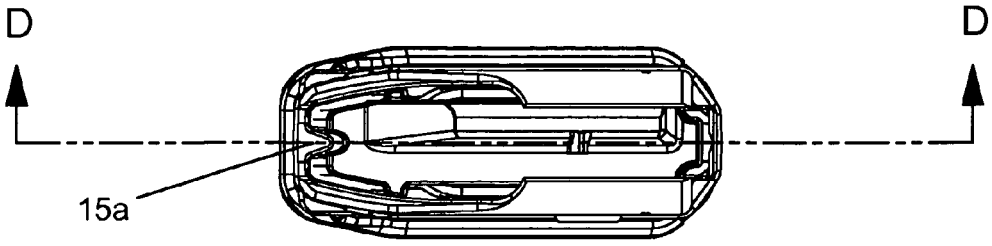
FIG. 7 is a top plan view of the magazine of FIG. 1, with the floor plate fully depressed.
Figure 8:
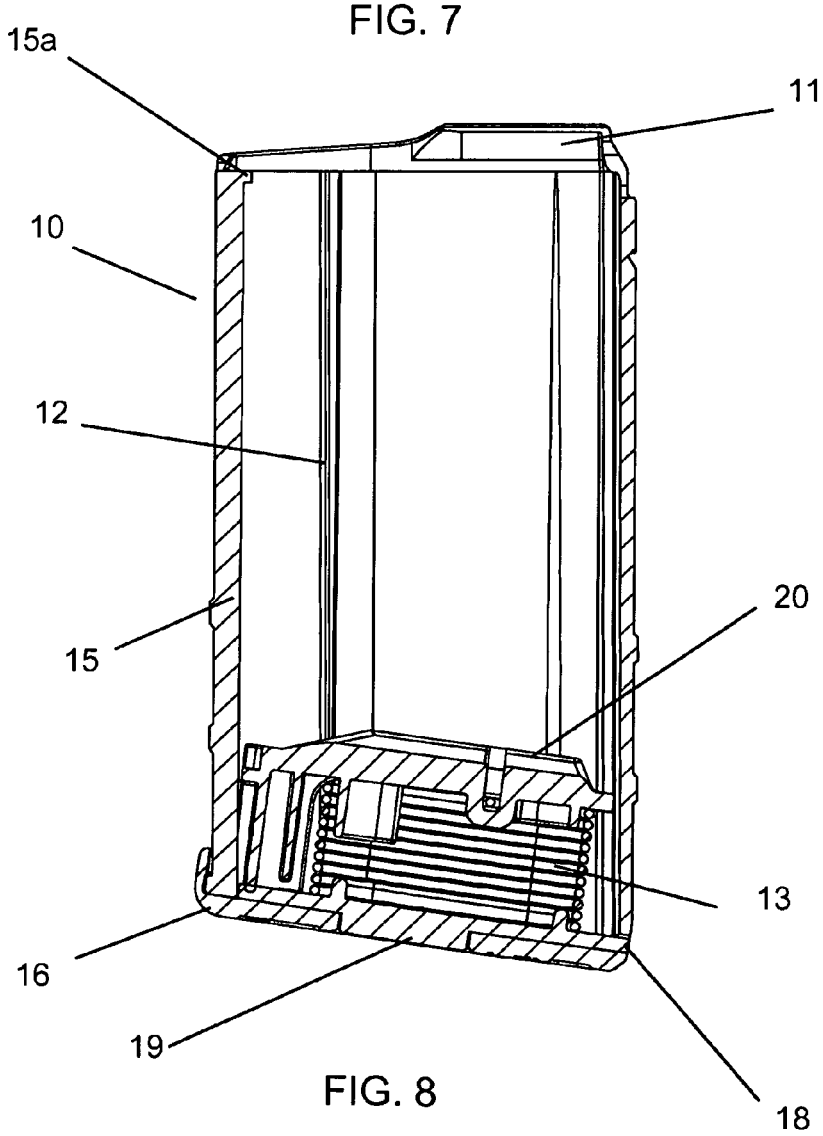
FIG. 8 is a sectional view of the magazine of FIG. 7, taken along line D-D.

With reference to FIG. 1, the magazine 1 generally comprises a body 10 having a floor end (covered by floor plate 16) and a feed end 14. Feed lips 11 are provided at the feed end 14 to interface with a weapon and to guide cartridges into the firing chamber of said weapon. The floor end is capped with a floor plate 16 which is secured by a lock plate 18. As shown in FIGS. 6 and 8, a spring 13 rests against the lock plate 18, centered by walls on the lock plate 18, and floor plate 16 combination and provides tension to bias the follower 20 and the floor plate 16 so that the follower 20 will progress up the magazine body 10 as ammunition is used. Floor plate 16 slides over a rim of the floor end, using a ledge to interface with the rim, and simultaneously over the lock plate 18. The floor plate 16 and lock plate 18 interface together with a tab 19 on the lock plate resting within a slot 17 of the floor plate (shown in FIGS. 4, 6 and 8), so, with the floor plate 16 holding the magazine 1 and the lock plate 18 holding the floor plate 16 laterally, as it is forced against the floor plate 16 by the spring 13, the floor plate 16 does not slide off the magazine 1. A protective impact cover 30 is also provided for use during storage. Magazine 1 may also features one or more indicator windows to view the spring 13. An indicator, which could be as simple as a colored dot or a dab of properly placed paint, is positioned on the spring and is viewable through the windows when the magazine 1 is assembled. Ideally, any windows are positioned on either side of the magazine body 10 and are close enough to the floor end so that they are not obscured when the magazine 1 is inserted in a weapon's magazine well. FIGS. 2-4 provide views of the magazine 1 assembled, FIG. 4 without the impact cover 40.

Inside the body 10, along the fore side of the magazine 1, is a rib 15, shown in FIGS. 5-8. The rib 15 serves three purposes. The first purpose is to provide additional stability and strength to the magazine body 10. The second purpose is to divide tips of cartridges, left from right, in their off-set stacking in the magazine. The third purpose is to provide an additional interface with the follower 20 to limit forward linear and axial tilt. The body also has two lateral guide rails 12 extending through the body 10. The guide rails 12 are flattened in front and angular towards the rear so as to present a more solid surface for the follower to abut and to guide cartridges as they travel through the magazine body 10 (FIGS. 2 and 3). So as to not interfere with feeding of cartridges in to the weapon, the guide rails 12 should terminate at approximately a cartridge's diameter of the feed end 14 of the magazine body (as defined by the level where the rib 15 terminates with tab 15*a*), or within ¼ inch for a 0.223 magazine. This is, however, only for the preferred embodiment, as the guide rails 12 can extend the entire length of the magazine body 10 and the magazine will still be functional, just not preferred.

It should also be noted that magazine body 10 presents no internal curve. The parent application presents a constant internal curve. The lower capacity magazine is less dependent on internal curvature and performs well without. Since there is no curve, the follower is redesigned to provide a slight upward pitch (axial tilt) function to aid in ammunition feeding to the weapon. Other disadvantageous motions, notably roll and side-to-side twisting (yaw) and downward pitch, are limited. As such, the follower 20 and associated ammunition travel more smoothly through the magazine body 10 with lessened round stack variation as compared to other 20 round straight magazines.

Figure 10:
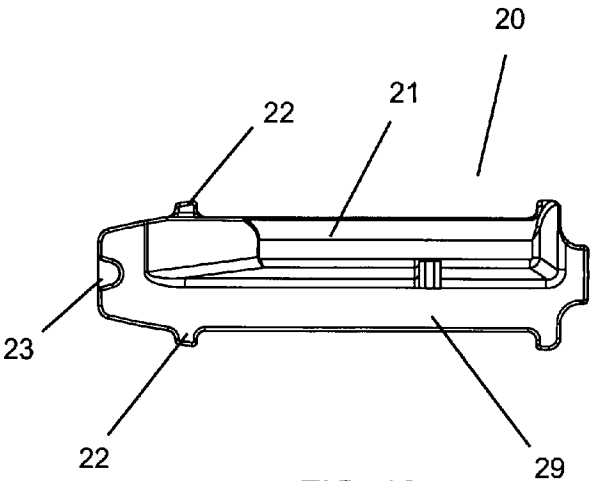
FIG. 10 is a top plan view of the follower of FIG. 9.
Figure 9:
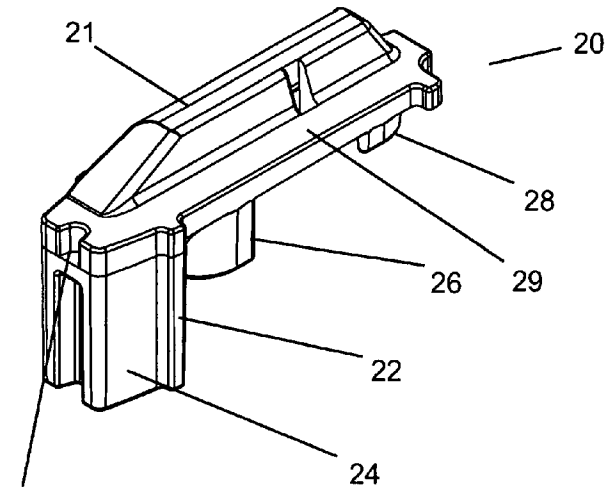
FIG. 9 is a perspective view of the follower according to the present invention.
Figure 11:
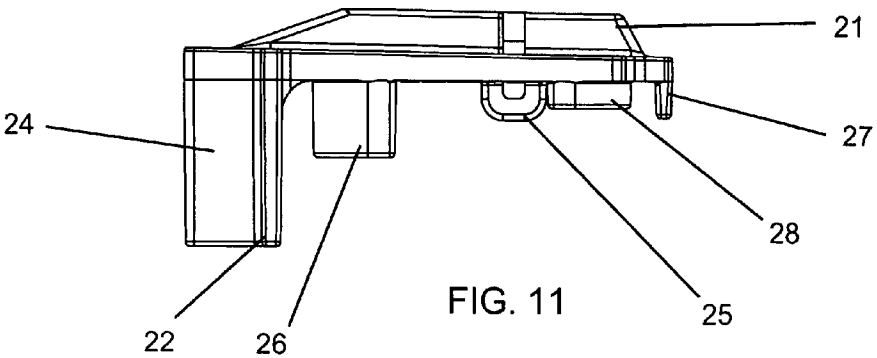
FIG. 11 is a left side plan view of the follower of FIG. 9.

As shown in FIGS. 9-11, the follower 20 has two tines, a forward tine 24 and hind tine 27. Both tines are elongated and extending from platform 29. The forward tine 24 presses against the ridge 15 and limits axial movement, the hind tine 27 is markedly shorter than forward tine 24 fits into trough, as shown in FIG. 2, to prevent lateral movement. The extension of the forward tine 24 inhibits axial movement, but the shorter length of the hind tine 27 allows the follower's rear to be pushed downward, particularly by the simple act of firing the weapon. The length of the forward tine 24, then, places a limit to the motion of the follower as a result of these forces. The extension of the tine 24 inhibits axial and lateral movement as the extension increases contact with the magazine body and provide more counter-torque when forces would cause such movement. However, the short hind tine 27, which barely extends beyond the level of the platform 29, allows some motion that is otherwise beneficial for the feeding of the ammunition into the weapon. The follower 20 also has two lateral arms 22 that fit alongside of the lateral fins 12 to further inhibit rotation. The follower 20 interfaces with spring 13 by attachment of the spring 13 to loop 25 and retention of the spring 13 by retaining walls 26, 28. Rear wall 28 is shorter than forward wall 26. This also allows for some axial tilt and allows the magazine spring 13 to be fully compressed in at asymmetric floor end of the magazine 1 (FIG. 8).

At the top of rib 15 is a slight tab 15*a* (FIGS. 5-8) that protrudes towards the interior of the magazine 1. Tab 15*a* serves as a block to prevent the follower 20 from exiting the feed end 17 of the magazine 1. It interfaces with a detent 23 provided in the follower 20 (FIGS. 9-11).

In the preferred embodiment, the magazine body is comprised of a long glass-reinforced thermoplastic polymer selected to resist the heat generated from firing a rifle. However, other polymers, like polycarbonate, may be used and the magazines may be made in any color or opacity (which can reduce or eliminate the need for a magazine level indicator). Some polymers, such as polycarbonate, may be used without reinforcement. Other reinforcement materials, such as steel, carbon fiber, or other materials may also be used to reinforce the magazine. Likewise, the magazine body may be made of other materials having suitable strength and durability, such as titanium, ceramics, laminates, amorphous metals, etc.

The magazine 1 is structured to increase its structural integrity. To that end, fore rib 15 provides added durability to the magazine. Protective cover 30 also provides reinforcement during storage, as pressures from the stored ammunition and spring 13 would normally force the feed lips 11 of the magazine 1 apart. Protective cover 30 interfaces with geometry on the magazine body 10 and forces the ammunition downward with an underside spacer, thereby absorbing and distributing the forces that would normally be applied to the feed lips 11 in a more advantageous manner. This relation is best described in the parent application. The cover 30 also serves as a magazine tool as the cover latch will fit between the feed lips 11 so as to push rounds of ammunition out of the magazine 1. It also has a specialized gauge to determine if the feed lips 11 have splayed or compressed in a manner to prevent operability of the magazine with the weapon.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An ammunition magazine comprising:

a. A hollow casing having a mostly rectangular cross-section and first and second open ends, the casing further comprising a forward rib extending the length of the magazine along a front internal side, said rib further comprising a tab projecting inwardly therefrom, and two guide rails extending a length of the magazine, from the first open end to the second open end and the guide rails situated along side walls of the casing, the guide rails extending at least mostly to the first open end and each presenting an angular cross-section throughout;

b. A follower residing within the casing, said follower further comprising:

i. A follower platform with two opposite tines, a forward tine and a rearward tine, extending generally perpendicularly and distally therefrom, the rearward tine barely extending below the level of the platform while the forward tine is significantly longer and the platform further comprising a detent situated to interface with the tab;

ii. Two side fins situated to interface with the casing's guide rails;

c. A floor plate capable of interfacing the magazine at the second end; and d. A follower spring residing between the follower and floor plate;

wherein the tines and the two side fins limit rotation of the follower within the casing and the tab and detent interface in a manner to prevent the follower from exiting the casing through the first end.

2. The magazine of claim 1, the magazine further comprising a rim about the second end and the floor plate being capable of a sliding relationship over said rim.

3. The magazine of claim 2, the floor plate further comprising and interior locking plate with a tab and an exterior floor plate with a mating slot and a ledge capable of interfacing with the rim.

4. The magazine of claim 1, further comprising a protective cover and interfacing geometry on the casing with which to secure the protective cover, the protective cover capable of forcing the follower downward and absorbing at least some pressure applied to the magazine by the spring.

* * * * *